United States Patent [19]

Best

[11] 4,055,459

[45] Oct. 25, 1977

[54] METHOD AND APPARATUS FOR PREVENTING THE ADHERENCE OF POLARIZED FOREIGN PARTICLES TO PAPER MACHINE COMPONENTS

[75] Inventor: Francis Brian Best, Pointe Claire, Canada

[73] Assignee: JWI Ltd., Canada

[21] Appl. No.: 700,520

[22] Filed: June 28, 1976

[51] Int. Cl.[2] ..... D21F 1/52; D21F 1/54

[52] U.S. Cl. ..... 162/192; 162/199; 162/272; 162/352; 162/374

[58] Field of Search ..... 162/192, 199, 272, 274, 162/351, 352, 360 DP, 374

[56] References Cited

U.S. PATENT DOCUMENTS

| | | | |
|---|---|---|---|
| 3,420,736 | 1/1969 | Kwasniewski et al. | 162/274 |
| 3,491,456 | 1/1970 | Candor et al. | 162/192 X |
| 3,778,342 | 12/1973 | Charbonneau | 162/352 |

FOREIGN PATENT DOCUMENTS

| | | | |
|---|---|---|---|
| 21,044 | 4/1961 | Germany | 162/192 |

*Primary Examiner*—Richard V. Fisher

*Attorney, Agent, or Firm*—Diller, Brown, Ramik & Wight

[57] ABSTRACT

A method and a system for preventing the accumulation of polarized foreign particles on a support surface of support elements positioned in contact with a moving fabric in a paper making machine. An electrically conductive fabric support surface of a support element is charged with an electrical charge of like polarity to the polarized foreign particles whereby the polarized foreign particles will be repelled from the support surface.

10 Claims, 5 Drawing Figures

METHOD AND APPARATUS FOR PREVENTING THE ADHERENCE OF POLARIZED FOREIGN PARTICLES TO PAPER MACHINE COMPONENTS

BACKGROUND OF INVENTION a. Field of the Invention

This invention relates to a method and a system for preventing pitch material in the pulp stock of paper making machines from adhering and building up on the fabric support surfaces of support elements such as foil blades and suction boxes used in such machines to remove water from the pulp in the forming section and to clean and condition the felts in the press section b. Description of Prior Art The usual paper making machine comprises in order, a forming section, press section and dryer section. In the forming section the water content of the stock is lowered from approximately 99.5% to the order of 80 – 85%. This is done as the stock, which has been spread on a travelling forming fabric, passes over a series of drainage foils and suction boxes. The forming fabric usually consists of a fine mesh woven metal or synthetic fabric which offers good support to the pulp stock and, at the same time, permits controlled drainage of some of the water therefrom.

After the sheet has been formed and removed from the forming section at the couch roll, a considerable percentage of the remaining 80 – 85% of water may be removed by means of pressing or squeezing the sheet in the press section before starting the more expensive water removal by means of vaporization through heat in the dryer section. The pressing or squeezing is done by passing the sheet through the nips of a series of press rolls while it is being supported on a press felt. The press felt is a relatively thick fabric of which one or both surfaces may be composed of a needled bat of synthetic or natural fibres.

In the forming section of the paper making machine the fabric runs over the forming board, foils and the suction boxes, and some of the water is drawn from the stock. Pitch material carried in the water or in the forming fabric tends to build up on the top surfaces of these components with detrimental results as their effectiveness is lowered. On the foils it may interfere with the critical leading edge and foiling angle and on the suction boxes it may eventually bridge over the holes or slots leading to the interior of the boxes and so reduce the effect of the vacuum therein. These components must then be removed for cleaning which may necessitate shutting down the whole machine. Pitch is a gummy tar-like substance which easily adheres to such components.

In the press section the press felt tends, after a time, to become loaded with debris from the sheet such as lint, chemicals and particularly pitch. Attempts have been made to clean the felt by a type of suction pipe which is placed in contact with the paper side surface of the felt. A simple version of such a suction pipe would comprise a pipe extending across the width of the felt in a run between two turning rolls. There would be a narrow slot opening into the pipe and running lengthwise of it. The pipe would be positioned so that the felt runs over the slot and the slot extends almost the entire width of the felt. A vacuum is supplied in the pipe which serves to draw water and debris off the surface of the felt. Usually a high pressure shower is impinged on the opposite side of the felt immediately preceding the suction pipe and this serves to dislodge foreign material which may then be more easily removed by the suction.

In order to improve the efficiency of this felt cleaning device it is usually fitted with a cover comprising spaced bars of material which resists wear and deterioration such as polyethylene. The slot or slots between the bars coincide with the slot leading into the interior of the pipe. Deckle pieces are provided to seal the cover slots from extending beyond the edges of the press felt. Such an arrangement is called a felt suction box or Uhle box.

Since modern forming fabrics and press felts are not worn out as quickly as conventional ones previously used, the extended life has laid more emphasis on the problem of keeping the machine and the felts clean of fibre fines, chemicals and pitch. These foreign materials adversely affect the efficiency of the foils and suction boxes of the forming section and clog the mat surface of a press felt and greatly reduce its porosity and therefore its water removing effectiveness.

In the case of the press felts, for example, this has made the efficient use of the Uhle boxes of even greater importance and particular attention must be paid to maintaining their efficiency by keeping them clean. In the case of most paper machines a build-up of pitch occurs on a Uhle box, starting at the leading edges of the bars or blades, and it becomes necessary to remove a box or individual blades periodically for cleaning off the pitch which would otherwise build up and obstruct the vacuum slot or cause damage by dropping off unto the run of the felt below.

The frequency with which cleaning off pitch is required in some operations, particularly from Uhle boxes, poses a real production problem and it is a feature of this invention to eliminate or at least alleviate the collection of pitch on foil blades, suction boxes and Uhle boxes.

Pitch which originates from resins in the wood usually occurs in the pulp stock as a gummy residue that forms in globules during the chemical treatment of wood pulp. These globules are carried in thin suspension in the pulp stock and find their way, via the forming fabric to the foils, etc. and from the surface of the formed paper sheet, to the press felt. The globules deposit on the felt or may be squeezed out of wood cells within the sheet. They accumulate and eventually interfere with the free passage of water through the felt. Some of the globules of pitch that are washed to the surface of the felt by the aforementioned high pressure shower then tend to deposit on the cover bars of the Uhle boxes as previously described. It has been found that the globules of pitch are invariably polarized.

SUMMARY OF INVENTION

It is a feature of the present invention to substantially prevent the accumulation of undesirable foreign particles on a support surface of support elements positioned in contact with a moving fabric in paper making machines.

It is a further feature of the present invention to improve the efficiency of foils, suction boxes, or the like support elements and to greatly reduce the incidence of clogging of the mat surface of a press felt in paper making machines.

It is a still further feature to prevent the adherence of pitch onto support surfaces of support elements in paper making machines and to facilitate its removal from the press felt in the press section of such machines.

Another feature is to provide an improved method and system for the removal of polarized foreign particles contained in wet pulp in a paper making machine and prevent the adherence of same on support surfaces of support elements in such machines.

According to the above features, from a broad aspect, the present invention provides a method of preventing the accumulation of polarized foreign particles on a fabric support surface of support elements positioned in contact with a moving fabric in a papermaking machine on which there is supported a pulp stock having polarized foreign particles. The method comprises connecting an electrical charge to a conductive portion of the support elements. The electrical charge is of like polarity to the polarized foreign particles whereby the polarized foreign particles will be repelled from at least a portion of the fabric support surface.

According to another feature of the present invention, there is provided in a papermaking machine support element having a fabric support surface to be positioned in contact with a moving fabric supporting a pulp stock having polarized foreign particles, the improvement which comprises the support element having at least a conductive portion thereof connected to a power supply to apply to the conductive portion an electrical charge of like polarity to the polarized foreign particles to repel these particles from at least a portion of the fabric support surface.

BRIEF DESCRIPTION OF DRAWINGS

A preferred embodiment of the present invention will now be described with reference to the examples illustrated in the accompanying drawings wherein.

Before describing the examples illustrating the present invention, it is pointed out that it is a known phenomenon that globules of pitch usually possess a negative electrical charge (or positive charge depending on the acidity of the pulp stock) and these globules are carried in thin suspension in the pulp stock. In papermaking machines the pitch is carried as insoluble globules and much of it is removed from the pulp stock along with the great quantities of water removed therefrom in the forming and press sections of the machine. As heretofore mentioned the present invention is concerned with a method and a system for preventing this pitch from depositing on the support surface of forming boards, foils, suction boxes, Uhle boxes or other support surfaces that come in contact with the fabric carrying the wood pulp.

DESCRIPTION OF PREFERRED EMBODIMENTS

Figure 1A:
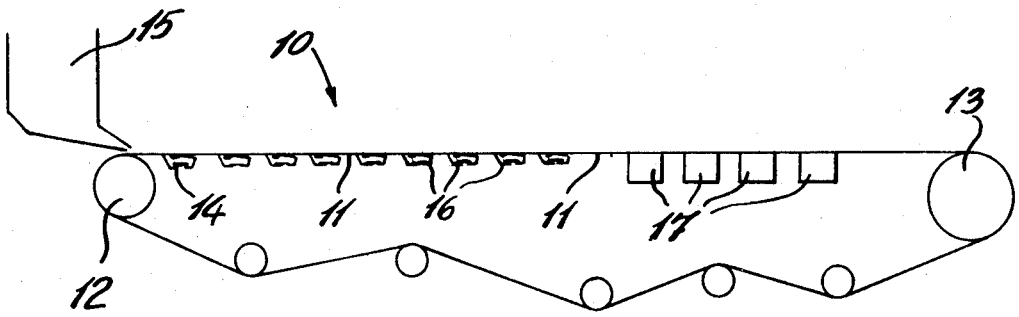
Fig. 1A PRIOR ART
FIG. 1A is a schematic side view of a forming section of a paper making machine to which the system of the present invention may be incorporated.
Figure 1B:
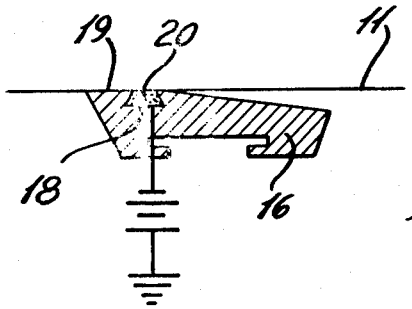
FIG. 1B is a side view of a foil blade of the type used in FIG. 1A and incorporating the system of the present invention.

Referring now to FIGS. 1A and 1B there is shown generally at 10 the forming section of a typical papermaking machine. As can be seen a forming fabric 11 is trained between a breast roll 12 upstream of the forming section and a couch roll 13 downstream of the forming section. A forming board 14 is located adjacent the breast roll in the vicinity of the head box 15 where pulp is discharged onto the forming fabric. A plurality of foil blades 16 follows downstream of the forming board and supports the forming fabric whilst at the same time draws water out of the pulp thereon. A plurality of suction boxes 17 follows downstream of the foil blades and also draws water from the pulp on the forming fabric.

Pitch contained in the wood pulp works its way through the forming fabric and deposits on the support surface of the elements 14, 16 and 17.

As shown in FIG. 1B an electrically conductive insert 18 is secured in the support surface 19 of one of the support elements 14, 16 or 17 and hereinshown as a foil blade 16. The insert 18 is an elongated element which extends longitudinally along the foil blade 16. The insert 18 is slidable within a cavity having outwardly tapered side walls whereby the insert is slidable within the foil from a side thereof. Also the insert has an upper flat contacting surface 20 which lies substantially in the same plane as the support surface 19 of the foil blade 16.

Although not shown in this figure, a D.C. power supply source of low voltage, preferably but not exclusively in the range of 1 to 24 volts D.C., has, for example, the negative terminal thereof connected to the insert. The positive terminal (not shown) is connected to ground.

Generally, the elements such as forming boards 14, foil blades 16, suction box 17 and Uhle box bars, which will be described later, are made of high density, high molecular weight polyethylene. This material is a very good dielectric and serves as an insulator for the electrically conducting insert 18 placed therein. Thus, when the elements are formed of insulating material the insert is insulated from ground. When the elements are constructed of electrically conducting material, for example, metal or metal coated with wear resistant metal bonded silicon or tungsten carbide, it is necessary to insulate the elements from the machine frame and then the entire element can be connected to the negative terminal of the D.C. power supply.

Figure 2:
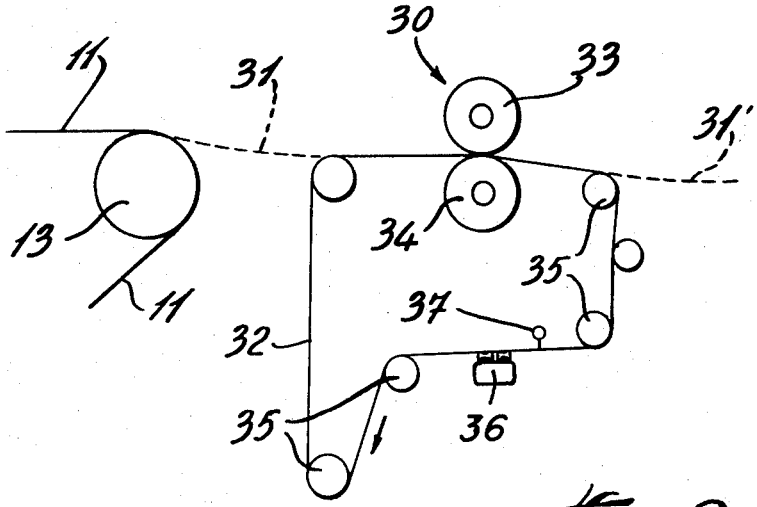
Fig. 2 PRIOR ART
FIG. 2 is a schematic side view of a press section of a paper making machine to which the system of the present invention may be incorporated.

Referring now to FIG. 2, there is shown generally at 30, a single press roll set as used in papermaking machines.

There are usually two or three such sets in a typical press section of the papermaking machine. As shown a wet paper sheet 31 is drawn from the forming fabric 11 of the forming section 10 and supported by a press felt 32 of the press section 30. Nip pressure is exerted between two press rolls 33 and 34 whereby to squeeze water from the pulp on the press felt. The pulp 31' then leaves the felt to pass to another similar set of the press section. A plurality of guide rolls 35 guide the wet felt over a Uhle box or felt suction box 36. Before the felt is subjected to the suction provided by the suction box 36 a high pressure shower 37 directs a stream of water transversely of the press felt 32 whereby to cause foreign particles within the felt to move to the surface of the felt. The pitch globules contained in the felt will therefore have a tendency to move to the surface of the wet felt and be removed along with some of the water at the Uhle box.

Figures 3A, 3B:
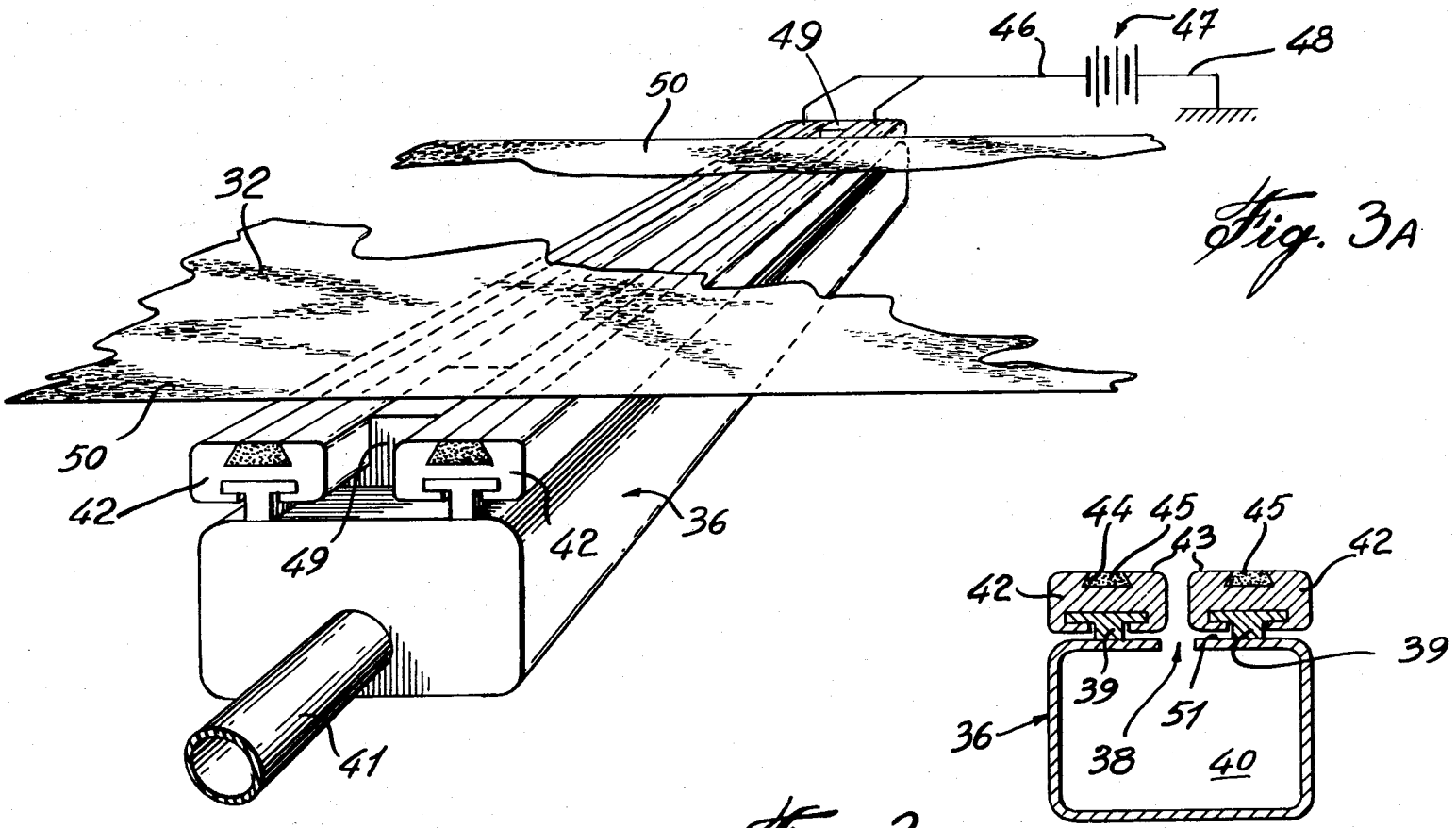
FIG. 3A is a perspective view of a Uhle box for a paper making machine and modified in accordance with the present invention.
FIG. 3B is a cross-section view of the Uhle box of FIG. 3A.

Referring now to FIGS. 3A and 3B there is shown the construction of the Uhle box or felt suction box 36 as shown in FIG. 2. As shown, the Uhle box 36 consists of a hollow enclosure having an elongated slot opening 38 centrally on the top wall 51 thereof. A vacuum source is applied to the hollow area 40 of the box 36 by suitable conduit connections such as 41. As herein-shown, two elongated support elements, called cover blades 42, are positioned on each respective side of the opening 38 and define support surfaces 43 on which the press felt 32 is supported. An elongated slot 44 having inwardly tapering side walls is provided longitudinally and centrally of each of the cover blades 42 whereby to slidingly receive an electrically conductive insert 45 to which, for example, the negative terminal 46 of a low voltage D.C. battery 47 is connected. The positive terminal 48 of the battery 47 is in this case connected to ground.

As also shown deckle pieces 49 are positioned between the ends of the cover blades 42 to support the side edges 50 of the press felt 32 and to provide vacuum seals at the ends of the slot. As shown, the blades 42 are slidably attached on T-bars 39 secured to the top wall 51 of the Uhle box 36.

In operation as the forming fabric or press felt containing water and entrained pitch particles passes on to a support surface of support elements which have a negative charge, the pitch is repelled from the support elements and is retained in suspension in the water from the pulp or from the fabric. The pitch does not adhere to the surface of these elements but remains in suspension in the water and may later be removed therefrom.

In an experiment set up at a paper mill, a Uhle box cover was fitted with two polyethylene bars serving as cover blades. Each blade was provided with a metal insert conductor as shown in FIGS. 3A and 3B. The inserts were discontinuous at the middle of the blades so that different polarity conditions could be experimented with at the same time. For example, at one side of the machine the positive terminal of a 12 volt storage battery was connected to the conducting inserts of the blades. The negative terminal of this battery was grounded to the papermaking machine frame.

At the other side of the papermaking machine, the negative terminal of another 12 volt storage battery was connected to the conducting inserts and the positive terminal of this other battery was grounded to the machine.

The papermaking machine was test run for several hours with these batteries connected to the Uhle box cover blades as described above. At the termination of the test, it was found that the sections of the cover blades that were connected to the positive side of the battery collected a normal amount of pitch. At the other side of the machine, where the cover blades were connected to the negative side of the battery, the bars remained completely clean of pitch and this occurred as a result of the repellent effect of the electrical charge provided by the insert which was of like polarity to the negative charge of the pitch globules.

It is to be understood that it is not intended to limit the present invention to the use of conducting inserts or to a 12 volt battery as described above. For example, as mentioned previously the support elements may be made of electrically conducting material, provided that it is adequately insulated from the frame of the machine. It so happens that hard-wearing inserts of stainless steel coated with tungsten carbide may be used because these materials are reasonably good electrical conductors. Such inserts will also lessen wear on the blades and thus serve a double purpose. Any source of direct current power may be used in place of batteries. In order to prevent accidents, it is advisable to keep the voltage low and a range of from 1 to 24 volts, is recommended, although not essential to the present invention.

In the examples of preferred embodiments herein described, the conducting inserts have been shown to be placed in approximately the middle of the surface of a cover blade in a Uhle box. However, the invention is not limited to this particular configuration of inserts or location thereof. Broadly, the electrical insert can be of any shape in cross-sectional size relative to a cover blade, provided that it is located on the blade and makes contact with it and with the forming wire or press felt and is insulated from the machine.

Although the above described experimental work was effected on a Uhle box cover of a press section, this system may be used with equally beneficial results on forming boards, foil blades and on forming section box covers where the components are fitted on their top surfaces with an electrically charged conductor, having a polarity depending upon the polarity of the charged particles, the polarity of the charged conductor being like that of the charged particles, in such a way that it makes contact with the forming fabric entirely across its width and is insulated from the machine frame.

It has been known to use "Micarta" bars in Uhle boxes and it has been found that these do not seem to attract as much pitch as polyethylene bars. Micarta is a trademark representing a material made of lamination of various fibres bonded with a phenolic resin. It is believed that this phenomenon is due to the relatively rough surface of the "Micarta" material which tends to hold more water than the smooth surface of the polyethylene material and this retained water enables some of the particles of pitch to float over this surface rather than adhere to it. In such cases, an electrical charge on the bar would provide even more effective results at repelling the charged particles of pitch having like polarity.

It is within the ambit of the present invention to provide any other obvious modifications of the present invention provided these fall within the ambit of the invention as broadly defined by the appended claims.

I claim:

1. A method of preventing the accumulation of polarized foreign particles on a fabric support surface of support elements positioned in contact with a moving fabric in a papermaking machine on which there is supported a pulp stock having polarized foreign particles comprising connecting an electrical charge to a conductive portion of said support elements, said electrical charge being of like polarity to said polarized foreign particles whereby said polarized foreign particles will be repelled from at least a portion of said fabric support surface.

2. A method as claimed in claim 1, wherein said step of connecting comprises connecting a negative terminal of a D.C. power supply to said conductive portion, and insulating said fabric support surface from a frame of said papermaking machine, said power supply having a positive terminal connected to ground.

3. A method as claimed in claim 2, wherein said D.C. power supply is a low voltage source, and wherein said conductive portion is an electrically conductive insert positioned in said support surface in contact with said moving fabric, said insert extending across the width of said moving fabric, said negative terminal being connected to said insert.

4. In a papermaking machine support element having a fabric support surface positioned in contact with a moving fabric supporting a pulp stock having polarized foreign particles, the improvement comprising said support element having at least a conductive portion thereof connected to a power supply to apply to the conductive portion an electrical charge of like polarity to said polarized foreign particles to repel said particles from at least a portion of said fabric support surface.

5. The system of claim 4, wherein said conductive portion is an electrically conductive insert positioned in contact with said moving fabric and extending longitudinally of said support element and, a D.C. power supply having a negative terminal thereof connected to said insert and a positive terminal connected to ground, said insert being insulated from ground.

6. The system of claim 5, wherein said support element is a foil blade, said insert having a contacting surface lying in substantially the same plane as the support surface of said foil blade.

7. The system of claim 4, wherein the support element is one or more cover blades of a Uhle box, said Uhle box being hollow and having one or more elongated slot openings, said cover blades being positioned on respective sides of one or more of said openings, means creating a vacuum in said box, an electrically conductive insert in each of said cover blades, a negative terminal of a D.C. power supply being connected to said inserts whereby at least a longitudinal portion of said support surface of each of said cover blades is negatively charged, said D.C. power supply having a positive terminal connected to ground.

8. The system of claim 7, wherein said insert has a contacting surface lying in substantially the same plane as the support surface of said cover blades.

9. The system of claim 4, wherein said support element is constructed of polyethylene, said conductive portion being an electrically conductive insert secured along said support element and having a contacting surface disposed in the same plane as said fabric support surface.

10. The system of claim 4, wherein said support element is constructed of a material having a surface capable of retaining water, said conductive portion being an electrically conductive insert secured along said support element and having a contacting surface disposed in the same plane as said fabric support surface.

* * * * *